US006484670B2

(12) United States Patent
Honma et al.

(10) Patent No.: US 6,484,670 B2
(45) Date of Patent: Nov. 26, 2002

(54) INCUBATOR

(75) Inventors: Naoki Honma, Saitama (JP); Yoichi Takahashi, Saitama (JP); Tatsuhiko Seki, Saitama (JP); Kazuo Matubara, Tokyo (JP)

(73) Assignee: Atom Medical Corporation, Tokyo (JP)

( * ) Notice: Subject to any disclaimer, the term of this patent is extended or adjusted under 35 U.S.C. 154(b) by 0 days.

(21) Appl. No.: 09/902,795

(22) Filed: Jul. 11, 2001

(65) Prior Publication Data

US 2002/0017248 A1 Feb. 14, 2002

(30) Foreign Application Priority Data

Jul. 14, 2000 (JP) ..... 2000-214640

(51) Int. Cl.[7] ..... A61G 11/00

(52) U.S. Cl. ..... 119/311; 600/22; 16/312; 16/313

(58) Field of Search ..... 119/35, 311; 422/63, 422/64, 104; 435/809; 237/14; 16/221; 74/569; 600/22

(56) References Cited

U.S. PATENT DOCUMENTS 1,418,693 A * 6/1922 Bauer
3,034,402 A * 5/1962 Alberetti ..... 88/53
3,539,239 A * 11/1970 Mallonn ..... 312/307
3,911,528 A * 10/1975 Rojic, Sr. ..... 16/128 R
3,955,241 A * 5/1976 Little ..... 16/298
4,181,037 A * 1/1980 Boon et al. ..... 74/569
4,692,963 A * 9/1987 Barroero ..... 16/275
4,788,746 A * 12/1988 Idler ..... 16/297
4,926,707 A * 5/1990 Yamada ..... 74/96
4,945,606 A * 8/1990 Eckel ..... 16/250
5,025,531 A * 6/1991 McCarty ..... 16/250
5,250,261 A * 10/1993 Porte II ..... 433/63
5,270,007 A * 12/1993 Porte I ..... 422/64
5,341,542 A * 8/1994 Hannan et al. ..... 126/194
5,355,558 A * 10/1994 Vertanen ..... 16/360
5,519,920 A * 5/1996 Runge et al. ..... 16/367
5,682,642 A * 11/1997 Michael ..... 16/229

* cited by examiner

*Primary Examiner*—Charles T. Jordan
*Assistant Examiner*—Bret C Hayes

(57) ABSTRACT

In this incubator, when the angle of a door to a nursing window of a hood is smaller than a rotation restricting angle, door rotation restricting means restrains the rotation of the door in an opening direction. Because of this reason, when the angle of the door is smaller than the rotation restricting angle, the door is not rotated in the opening direction beyond the rotation restricting angle and the angle of the door does not exceed the rotation restricting angle, even if the door is pushed by an accommodated baby from the inside of the hood under the state wherein the door is not fixed in the closing state by a door fixing device. Therefore, even if opening and closing operation for the nursing window is not securely performed, the environment inside the hood hardly deviates from the physiological environment appropriate for the accommodated baby to say the least.

7 Claims, 8 Drawing Sheets

INCUBATOR

BACKGROUND OF THE INVENTION

1. Field of the Invention

The present invention relates to an incubator designed to bring up premature. babies or the like, who are not capable of adjusting their temperature or the like by themselves without help, by providing them with an appropriate physiological environment.

2. Description of the Related Art

FIGS. 1–4 illustrate a related art of the incubators. As shown in FIG. 4, the incubator 11 of the related art is installed with a transparent hood 12 on a base unit 14 on a base stand 13 for accommodating a premature baby or the like, and the hood 12 is provided with a nursing window 15 for applying treatment to the accommodated baby inside the hood 12 from the outside of the hood 12 and with a transparent door 16 made of acrylic resin for opening and closing the nursing window 15. The door 16 and the hood 12 are respectively installed with rotation members 17 and bearings 18 shown in FIG. 3.

The rotation members 17 and the bearings 18 are respectively provided with cylindrical rotation shafts 21 and completely round bearing holes. 22, and, by inserting the rotation shafts 21 into the bearing holes 22, the door 16 is rotatably supported on the hood 12. Since the rotation shafts 21 are positioned outside the nursing window 15 and on the side of the base stand 13, the door 16 rotates by its own weight either in the direction to open or in the direction to close the nursing window 15 depending on whether the angle of the door 16 to the nursing window 15 is larger or smaller than a given angle, and the given angle is called a critical angle in the specification of the present invention.

The door 16 and the hood 12 are provided with door fixing devices 23, and the door fixing devices 23 consist of a nursing window opening and closing knob 24 rotatably installed on the door 16 and a nursing window opening and closing knob receiver 25 of hook shape installed on the front of the hood 12. Namely, as shown in FIG. 1, by fitting the nursing window opening and closing knob 24 into the nursing window opening and closing knob receiver 25, the door 16 is fixed by the door fixing devices 23 in the state wherein the door 16 closes the nursing window 15. The door 16 is provided with hand insertion windows 26 of one touch type, and the sides of the hood 12 are also provided with hand insertion windows (not illustrated) of gather-up type.

A bed (not illustrated) for an accommodated baby is provided inside the hood 12, and bed tilting arms 27 are provided near the nursing window 15. While the bed can be tilted by manipulating one bed tilting arm 27, the height of the bed can be adjusted by simultaneously manipulating both bed tilting arms 27. A control unit 28 is provided near one of the bed tilting arms 27, and buttons (not illustrated), displays (not illustrated) and the like to control temperature, humidity, oxygen density and the like inside the hood 12 to appropriate values for the accommodated baby are provided on the control unit 28. The base stand 13 is installed with casters 31.

In the case of the incubator 11 of the related art such as the above, when any treatment is required to apply to an accommodated baby, a doctor, a nurse or the like releases the fixation of the door 16 by rotating the nursing window opening and closing knob 24 to remove the nursing window opening and closing knob 24 from the nursing window opening and closing knob receiver 25, opens the nursing window 15 thereafter by rotating the door 16 and applies treatment to the accommodated baby. When treatment to the accommodated baby is finished, the nursing window 15 is closed by door 16 and the door 16 is fixed in the closing state by the door fixing devices 23 in a reverse order of the operation mentioned above.

After finishing treatment to the accommodated baby, however, even if operation up to closing the nursing window 15 by the door 16 is performed, it is possible to overlook the operation to fix the door 16 in a closing state by the door fixing devices 23. Besides, as shown in FIG. 2, if the nursing window opening and closing knob 24 is rotated to the same angle position as the angle position where the nursing window opening and closing knob 24 is fitted into the nursing window opening and closing knob receiver 25 during treatment to the accommodated baby for some reason, it is possible that though the operator thinks he or she has rotated the nursing window opening and closing knob 24 after the nursing window 15 was closed by the door 16, the nursing window opening and closing knob 24 has not actually been fitted into the nursing window opening and closing knob Receiver 25, and the door 16 is not fixed by the door fixing device 23 in a closing state.

Moreover, if the inside of the hood 12 is humidified to a high humidity, the inside surface of the acrylic resin made door 16 exposed to highly humid air expands, and thereby the portion of the door 16 near the nursing window opening and closing knob 24 not supported by the rotation shaft 21 warps to the outside surface. As a result, even if the operator rotates the nursing window opening and closing knob 24 after the nursing window 15 is closed by the door 16, the nursing window opening aid closing knob 24 may not be fitted into the nursing window opening and closing knob receiver 25, and thus the door 16 may not be fixed by the door fixing devices 23 in a closing state.

Furthermore, in any of these cases, if the door 16 is rotated until the angle of the door 16 to the nursing window 15 becomes smaller than the critical angle, the nursing window 15 is anyway closed by biasing force for rotating the door 16 in the direction to close the nursing window 15 by its own weight, and therefore the operator may not recognize that the door 16 is not fixed in a closing state by the door fixing devices 23.

However, since the biasing force for rotating the door 16 in the direction to close the nursing window 15 by its own weight is not strong, the door 16 is rotated to open the nursing window 15 if the door 16 is pushed from the inside of the hood 12 by the foot or the like of the accommodated baby under this state. If the nursing window 15 is kept open, the environment inside the hood 12 deviates from the physiological environment appropriate for the accommodated baby and thus it is not preferable to the accommodated baby.

SUMMARY OF THE INVENTION

It is accordingly an object of the present invention to provide the incubator wherein, even if opening and closing operation of the nursing window is not securely performed, the environment inside the hood can be maintained to the physiological environment appropriate for the accommodated baby or at least the environment inside the hood hardly deviates from the physiological environment appropriate for the accommodated baby.

In the incubator according to the present invention, if the angle of the door to the nursing window of the hood is smaller than the rotation restricting angle, the door rotation restricting means restrains the rotation by restraining the movement of the center of the rotation from the first position to the second position accompanied by the rotation of the door in the opening direction. Thus, in the case that the angle of the door is smaller than the rotation restricting angle, even if the door is pushed by the accommodated baby from the inside of the hood under the state wherein the door is not fixed by the door fixing means in a closing state, the door does not rotate in the opening direction beyond the rotation restricting angle and the angle of the door does not exceed the rotation restricting angle.

Even if the angle of the door is smaller than the rotation restricting angle, the door rotation restricting means permits the rotation of the door within the angle between the rotation restricting angle and the angle at the state wherein the door closes the nursing window. Because of this reason, even if the angle of the door is smaller than the rotation restricting angle, the nursing window can be closed by the door by further rotating the door in the closing direction, and the operator can fix the door in a closing state by the door fixing means.

Even if the angle of the door is smaller than the rotation restricting angle, the door rotation restricting means merely restrains at the rotation restricting angle the rotation by restraining the movement of the center of the rotation from the first position to the second position accompanied by the rotation of the door in the opening direction, and the supporting means also supports the door in the state wherein the center of the rotation is movable between the first position and the second position. Because of this reason, when the center of the rotation is moved from the first position to the second position by resisting the force to bias the center of the rotation to the first position, the door can be rotated in the opening direction beyond the rotation restricting angle.

On the other hand, while the door rotation restricting means rotates the door in the closing direction if the angle of the door is smaller than the critical angle, it rotates the door in the opening direction if the angle of the door is larger than the critical angle. Because of this reason, if the door is rotated in the closing direction until the angle of the door becomes smaller than the critical angle, the door rotation restricting means further rotates the door in the closing direction thereafter, making the angle of the door smaller than the rotation restricting angle as well as moving the center of the rotation from the second position toward the first position by biasing. Also, if the door is not rotated in the closing direction until the angle of the door becomes smaller than the critical angle, the door rotation restricting means rotates the door in the reverse direction or in the opening direction and thereby the nursing window is opened, and the operator can immediately recognize the opening of the nursing window and thus close the nursing window again.

Therefore, even if the operation up to closing the nursing window by the door and fixing the door in the closing state by the door fixing means is not securely performed, the angle of the door does not become larger than the rotation restricting angle, and also even if the door rotation angle is not sufficient when the nursing window is closed, the operator can immediately recognize the opening of the nursing window and thus can close the nursing window again. Because of this reason, even if opening and closing operation of the nursing window is not securely performed, the environment inside the hood can be maintained to the physiological environment appropriate for the accommodated baby or at least the environment inside the hood hardly deviates from the physiological environment appropriate for the accommodated baby.

In the preferred incubator of the present invention, on the occasion of rotation from the opening state to the closing state, the door rotation restricting means permits a movement of the center of the rotation accompanied by the rotation and thus permits the rotation. Therefore, the rotation of the door in the closing direction is not restrained by the door rotation restricting means, and the operation of closing the nursing window by rotating the door is not hindered by the door rotation restricting means.

DETAILED DESCRIPTION OF THE PREFERRED EMBODIMENT

Figure 7:
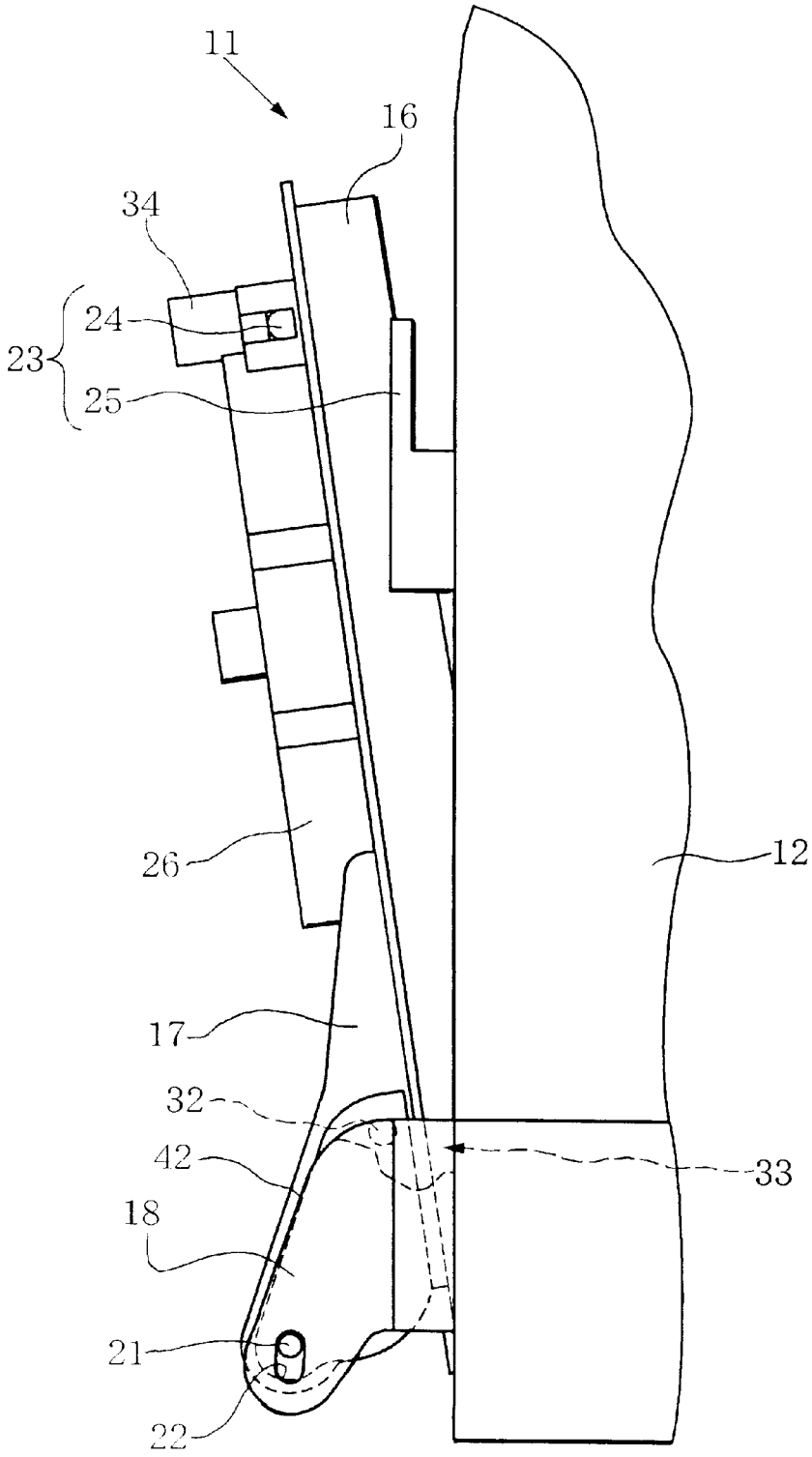
FIG. 7 shows the main portion of one embodiment of the present invention and is a side view in the state wherein the nursing window is being opened.
Figure 8:
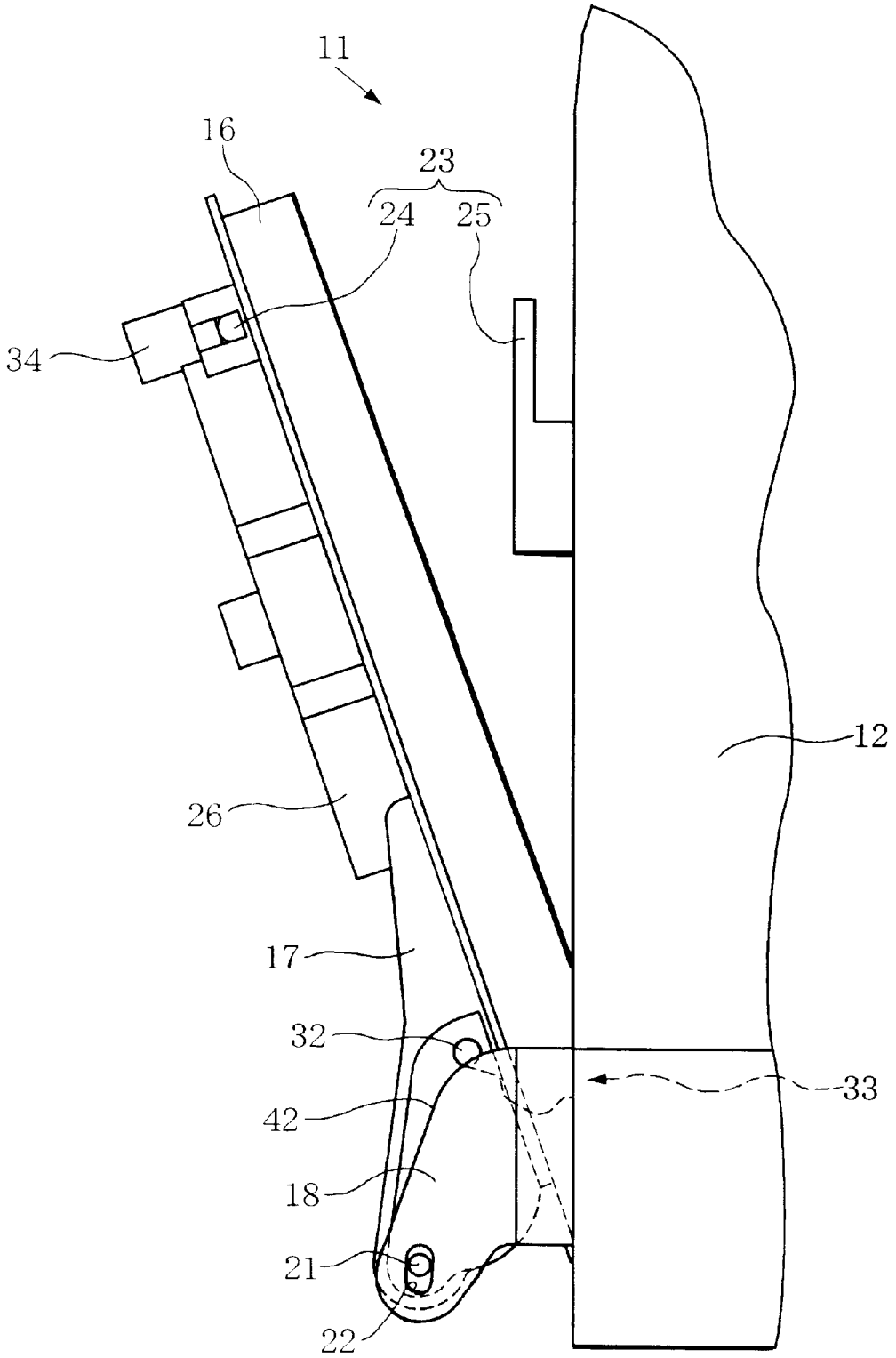
FIG. 8 shows the main portion of one embodiment of the present invention and is a side view in the state wherein the angle of the nursing window is a critical angle.
Figure 9:
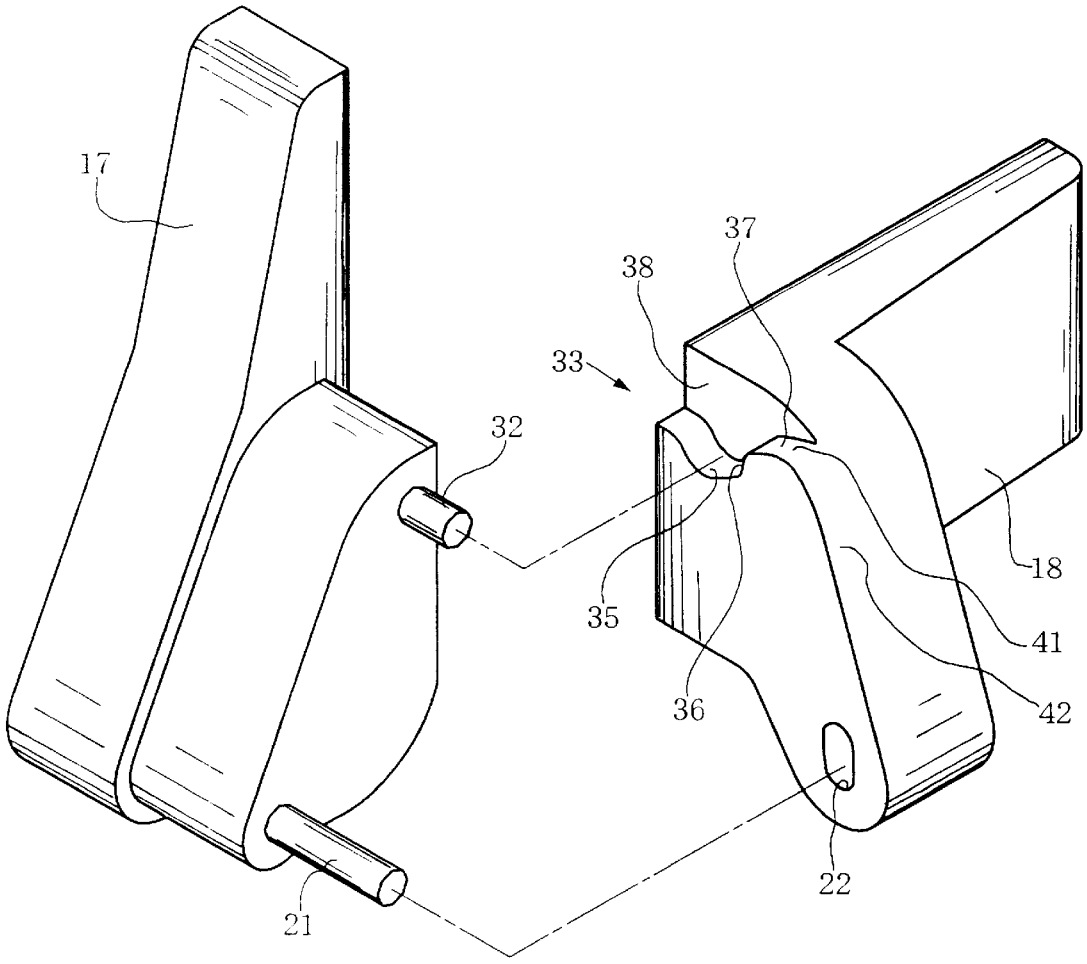
FIG. 9 is an exploded perspective view showing the main portion of one embodiment of the present invention.
Figure 10:
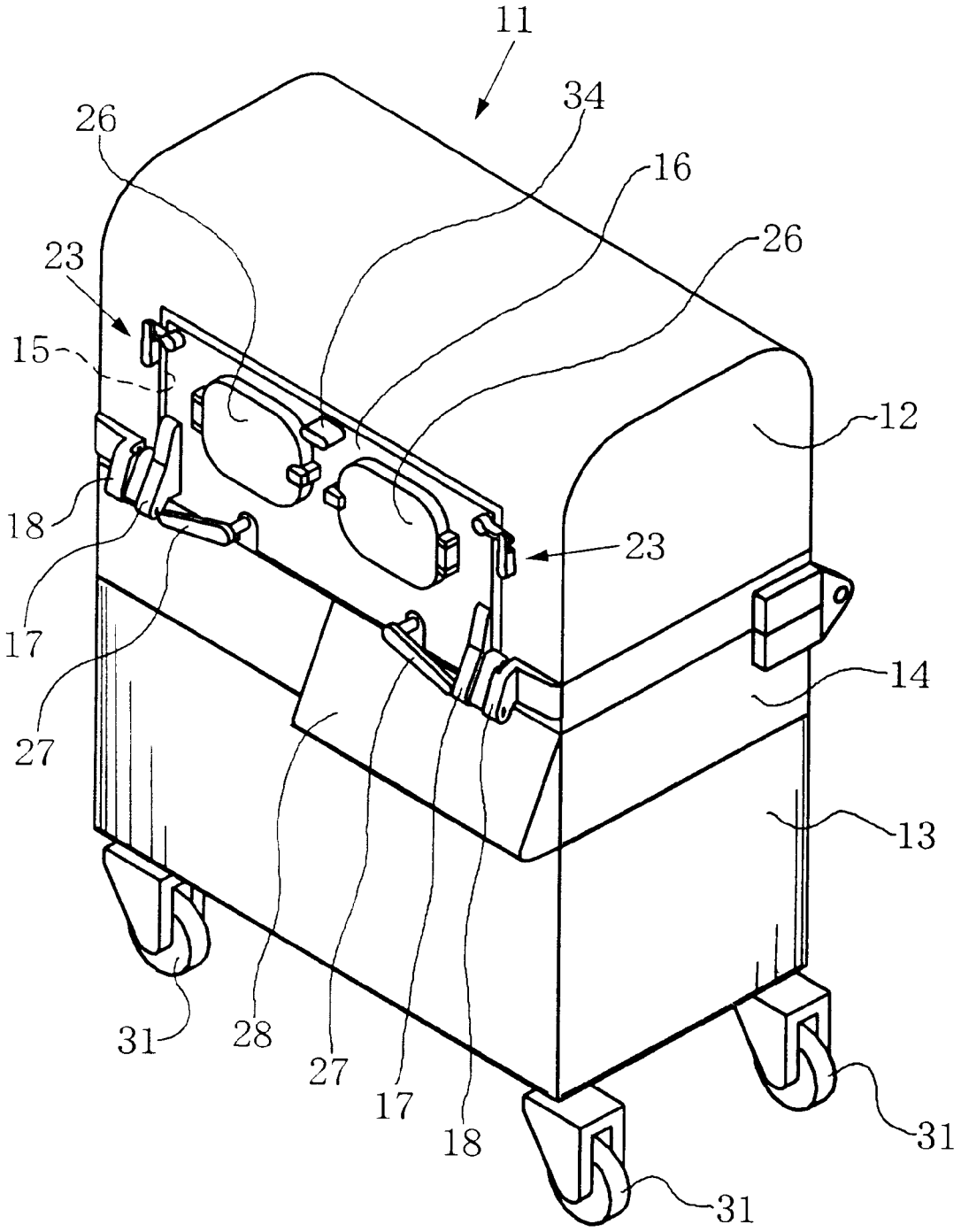
FIG. 10 is a perspective view showing the whole of one embodiment of the present invention.

An embodiment of the present invention will now be described with reference to FIGS. 5–10. As shown in FIG. 9, a rotation member 17 of an incubator 11 of the present embodiment is provided with a rotation restricting shaft 32 in addition to a rotation shaft 21, a bearing hole 22 of bearings 18 is of long hole shape, and a recess 33 is provided at the bearings 18 to receive the rotation restricting shaft 32. Furthermore, as shown in FIG. 10, a door 16 is provided with a knob 34. Except for the above points, the incubator 11 of the present embodiment has the substantially same construction as that of the incubator 11 of one related art as shown in FIGS. 1–4.

Figure 6:
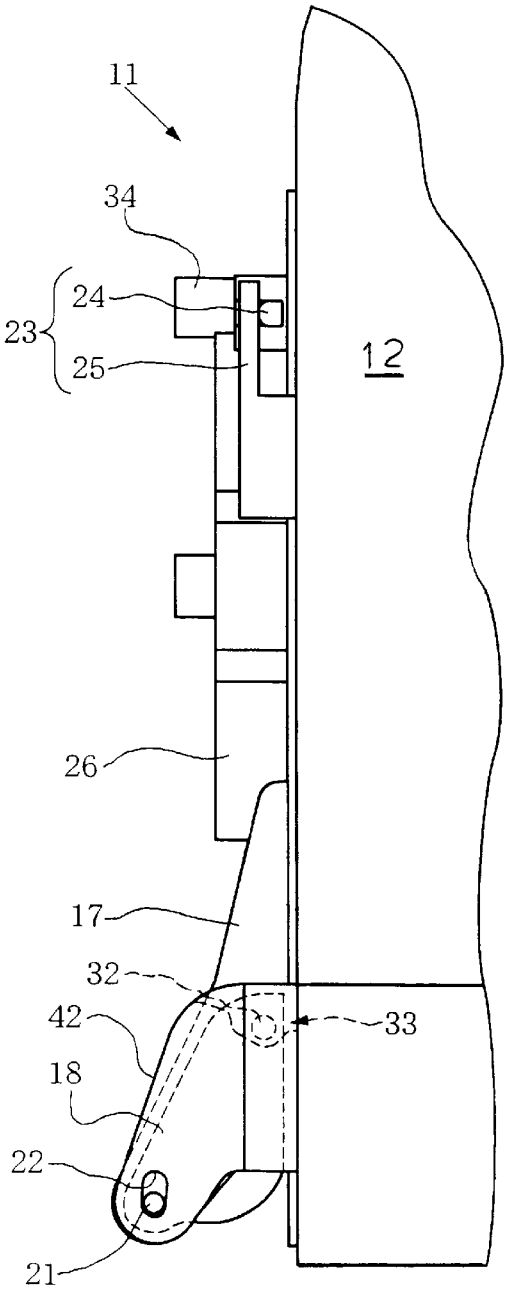
FIG. 6 shows the main portion of one embodiment of the present invention and is a side view in the state wherein the nursing window is closed.

As shown in FIG. 9, a bottom 35 of a channel shape, a steep slope 36 and a gentle slope 37 sequentially continue inside a recess 33, and the recess 33 is formed of these parts and a side 38. The top 41 of the slope 37 is part of the boundary between the recess 33 and the outer surface 42 of the bearing 18. As shown in FIG. 6, in the state wherein a door 16 closes a nursing window 15, a rotation shaft 21 inserted into a bearing hole 22 is in contact with the end face on the opposite side of a nursing window opening and closing knob receiver 25 in the bearing hole 22 by the weight of the door 16 itself, and a rotation restricting shaft 32 is also located above the deepest section of the bottom 35.

Under this state, by means of rotating a nursing window opening and closing knob 24 and fitting it into the nursing window opening and closing knob receiver 25, the door 16 can be fixed in the closing state by a door fixing device 23. In order to open the nursing window 15 from this state, after releasing fixation of the door 16 by the door fixing device 23, a finger is put on a knob 34 and the door 16 is lifted while resisting the weight of the door 16 itself until the rotation shaft 21 comes into contact with the end face of the bearing hole 22 on the side of the nursing window opening and closing knob receiver 25. Then, as shown in FIG. 7, the door 16 is rotated in the direction to open the nursing window 15.

In the state wherein the rotation shaft 21 is in contact with the end face of the bearing hole 22 on the side of the nursing window opening and closing knob receiver 25, even if the door 16 is rotated in the direction to open the nursing window 15, the rotation restricting shaft 32 does not come into contact with any of the bottom 35, slope 36 and slope 37. Because of this reason, until the rotation restricting shaft 32 reaches above the top 41, the door 16 can be smoothly rotated. In the case of this incubator 11, as shown in FIG. 8, the angle of the door 16 to the nursing window 15 when the rotation restricting shaft 32 is located above the top 41 is the critical angle. At this time, the rotation shaft 21 is located near the end face of the bearing hole 22 on the side of the nursing window opening and closing knob receiver 25.

Because of this reason, when the rotation restricting shaft 32 has reached above the top 41, it is not necessary to keep lifting the door 16 by resisting the weight of the door 16 itself, but the rotation restricting shaft 32 may be brought into contact with the top 41. If the door 16 is slightly rotated in the direction to open the nursing window 15 from this state, the rotation restricting shaft 32 slides down on the outside surface 42 by the weight of the door 16 itself, the rotation shaft 21 moves toward the end face of the bearing hole 22 on the opposite side of the nursing window opening and closing knob receiver 25, and the door 16 is also rotated in the opening direction. When the rotation shaft 21 comes into contact with the end face of the bearing hole 22 on the opposite side of the nursing window opening and closing knob receiver 25, the rotation shaft 21 rotates at this position and at the same time the door 16 is further rotated in the opening direction.

Also, even if the rotation restricting shaft 32 is in contact with the slope 37, since the gradient of the slope 37 is gentle, the rotation restricting shaft 32 can be slid on the slope 37 to the top 41 by the combined force of operating force to rotate the door 16 in the opening direction and the weight of the door 16 itself. Because of this reason, it may be performed that the rotation restricting shaft 32 is brought into contact with the slope 37 at the time when the rotation restricting shaft 32 has reached above the slope 37 and that operating force to rotate the door 16 in the opening direction is applied to the door 16 until the rotation restricting shaft 32 reaches the top 41.

In order to close the nursing window 15 by the door 16 from the state wherein the nursing window 15 is opened by the door 16, the door 16 is rotated in the closing direction, as in a reverse order of the above operation. Though at the time when the door 16 is brought to a certain angle to the nursing window 15 the rotation restricting shaft 32 comes into contact with the outside surface 42, since the gradient of the outside surface 42 is gentle, the rotation restricting shaft 32 slides on the outside surface 42 to the top 41 by the combined force of operating force to rotate the door 16 in the closing direction and the weight of the door 16 itself, and the rotation shaft 21 also moves, accompanied by said sliding, toward the end face of the bearing hole 22 on the side of the nursing window opening and closing knob receiver 25.

When the rotation restricting shaft 32 has been located on the top 41, only by slightly rotating the door 16 in the direction to close the nursing window 15 and then by the weight of the door 16 itself, the rotation restricting shaft 32 slides down on the slope 37 and on the slope 36 into the recess 33, the rotation shaft 21 moves to the end face of the bearing hole 22 on the opposite side of the nursing window opening and closing knob receiver 25 and the door 16 is also rotated in the closing direction. By fitting the nursing window opening and closing knob 24 into the nursing window opening and closing knob receiver 25 by rotating the nursing window opening and closing knob 24 in the state wherein the door 16 closes the nursing window 15, the door 16 is fixed to the closing state by the door fixing device 23.

Though the weight of the door 16 itself is used at any of the opening operation and closing operation mentioned above of the nursing window 15, the weight of the door 16 itself may not be necessarily used. As shown in FIG. 8, if the rotation restricting shaft 32 is in contact with the top 41, the rotation shaft 21 is only located near the end face of the bearing hole 22 on the side of the nursing window opening and closing knob receiver 25 and it is not in contact with this end face. However, if the rotation shaft 21 is brought into contact with the end face of the bearing hole 22 on the side of the nursing window opening and closing knob receiver 25, though it is necessary to keep lifting the door 16 by resisting the weight of the door 16 itself, the rotation restricting shaft 32 does not come into contact with any of the bottom 35, slope 36, slope 37 and top 41 even when the door 16 is rotated, and thus the door 16 can be smoothly rotated.

Figure 1:
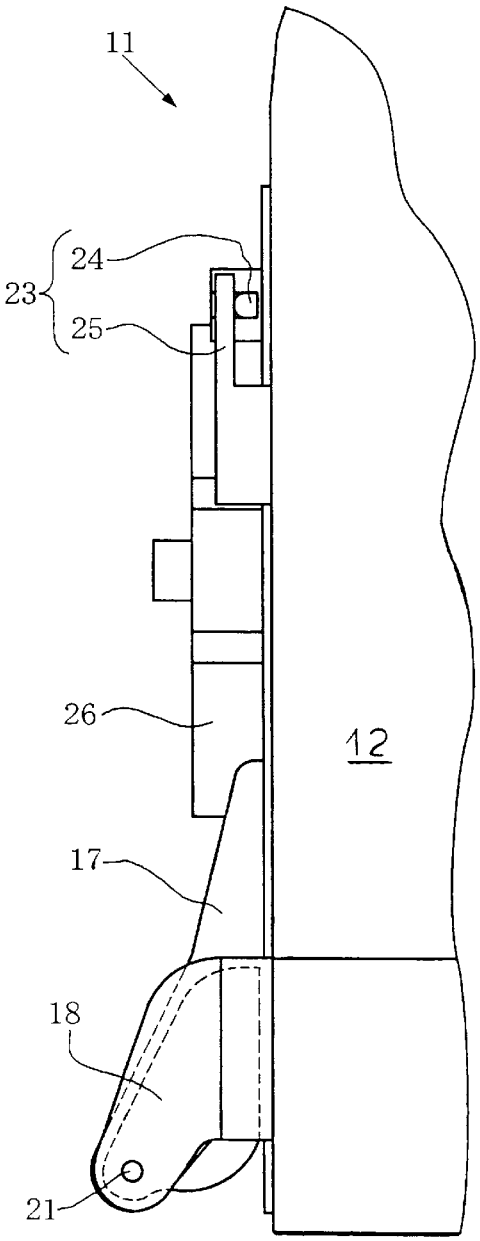
FIG.1 RELATED ART
FIG. 1 shows the main portion of one related art of the present invention and is a side view in the state wherein the nursing window is closed.
Figure 2:
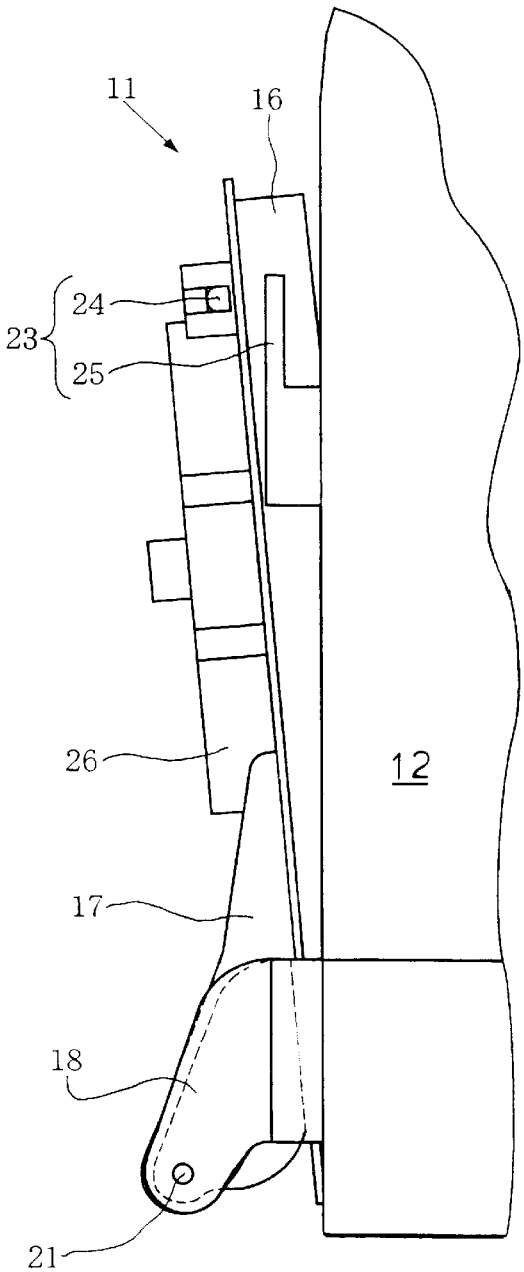
FIG.2 RELATED ART
FIG. 2 shows the main portion of one related art of the present invention and is a side view in the state wherein the nursing window is being closed.
Figure 3:
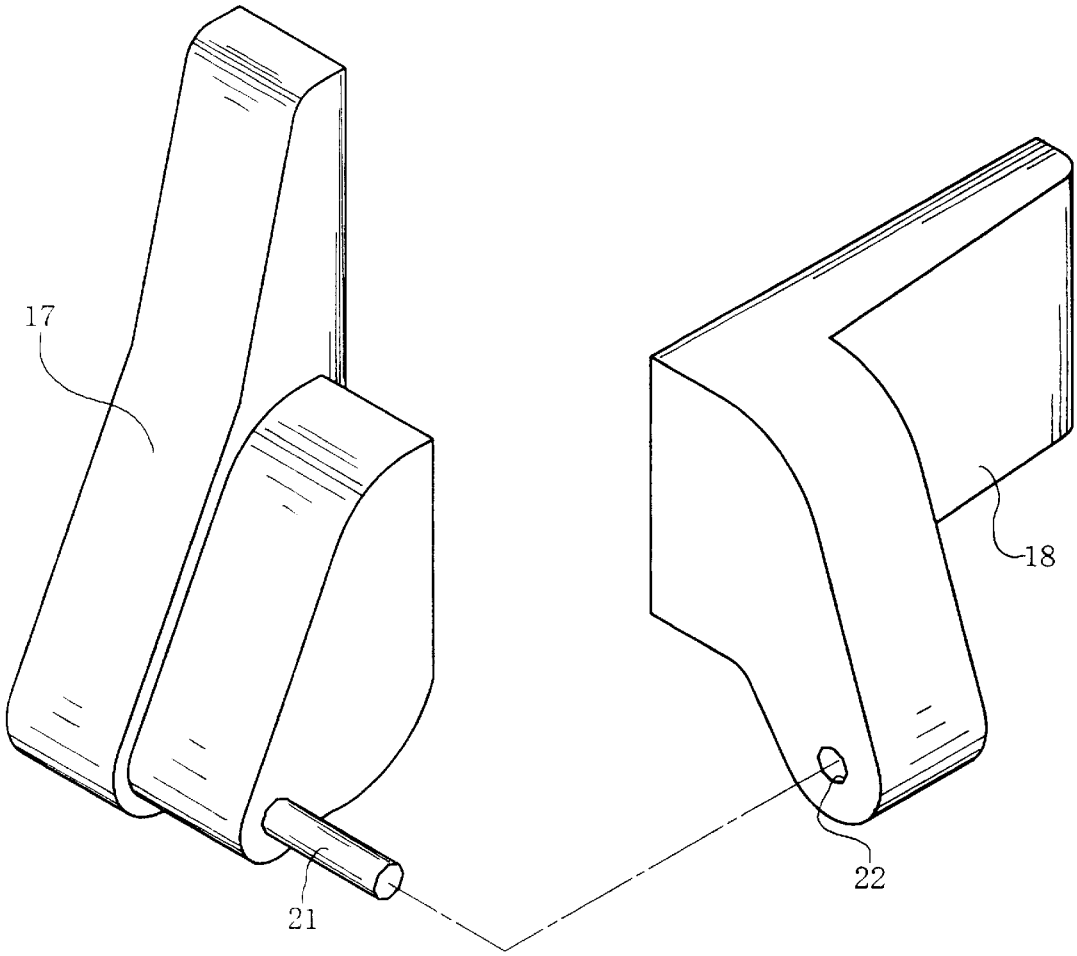
FIG.3 RELATED ART
FIG. 3 is an exploded perspective view showing the main portion of one related art of the present invention.
Figure 4:
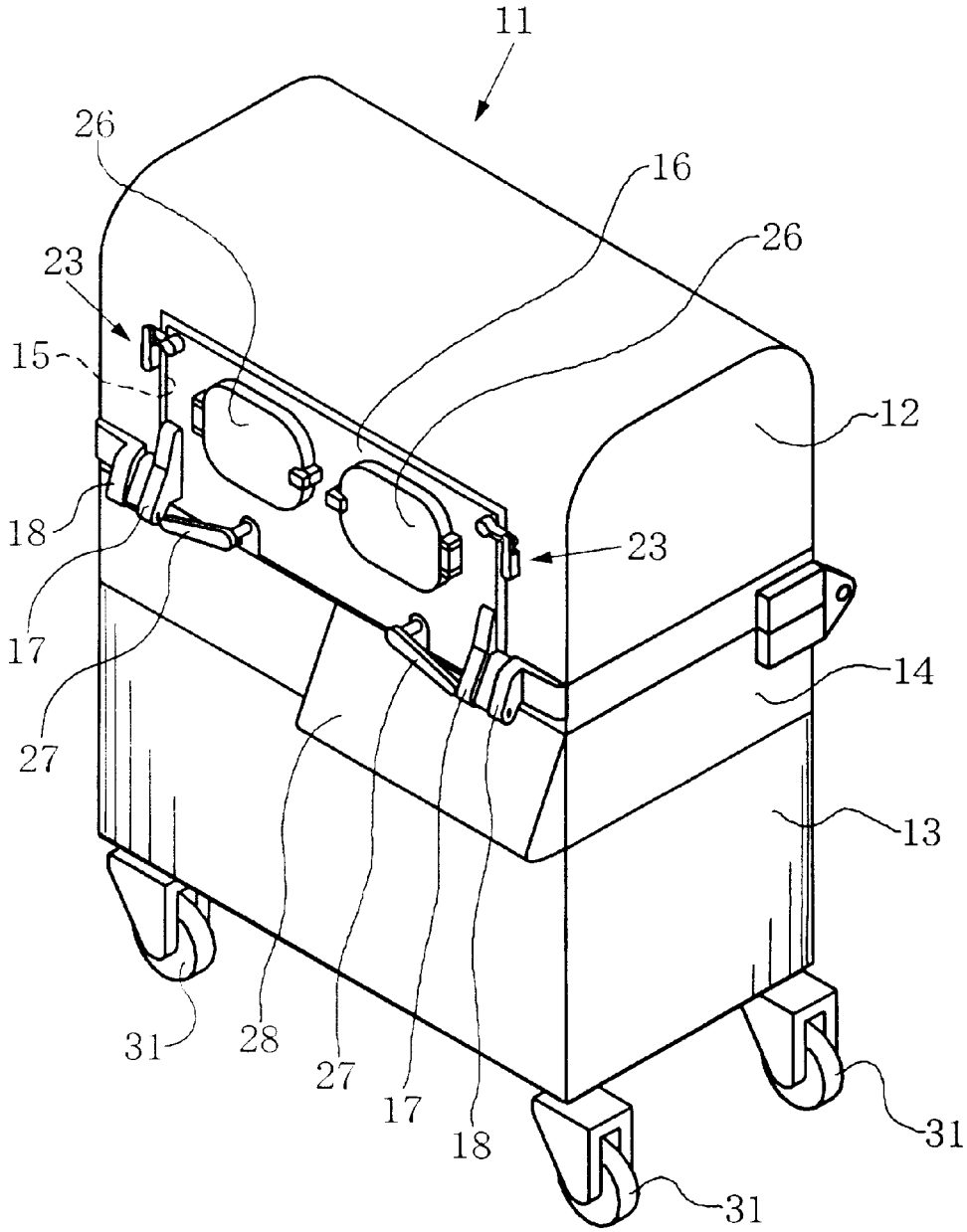
FIG.4 RELATED ART
FIG. 4 is a perspective view showing the whole of one related art of the present invention.
Figure 5:
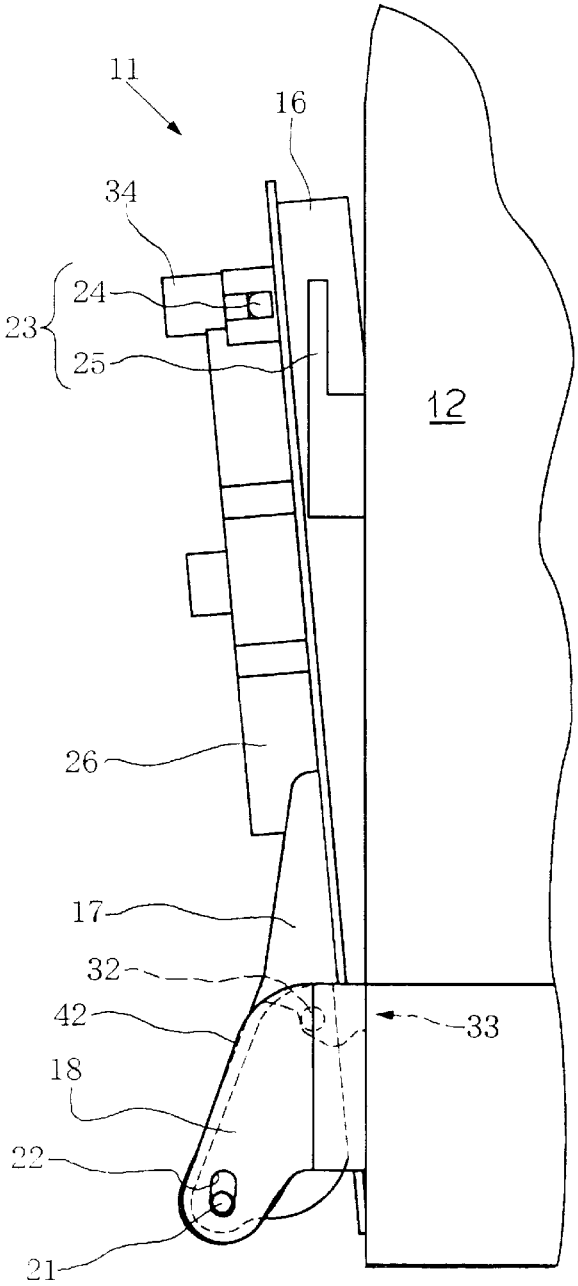
FIG. 5 shows the main portion of one embodiment of the present invention and is a side view in the state wherein the nursing window is halfway opened.

In the meantime, the rotation shaft 21 is always biased by the weight of the door 16 itself to the location where it is in contact with the end face of the bearing hole 22 on the opposite side of the nursing window opening and closing knob receiver 25. Because of this reason, as shown in FIG. 6, under the state wherein the rotation restricting shaft 32 is located above the bottom 35 of the recess 33, unless the door 16 is kept lifting, the rotation shaft 21 is in contact with the end face of the bearing hole 22 on the opposite side of the nursing window opening and closing knob receiver 25. As a result, as shown in FIG. 5, even if the door 16 is rotated in the opening direction from this state, the rotation restricting shaft 32 is brought into contact with the slope 36.

However, since the gradient of the slope 36 is steep, by only the combined force of the force to rotate the door 16 in the opening direction and the weight of the door 16 itself, the rotation restricting shaft 32 cannot slide on the slope 36 up to on the slope 37, and the rotation shaft 21 cannot also move toward the end face of the bearing hole 22 on the side of the nursing window opening and closing knob receiver 25. In other words, by only the combined force of the force to rotate the door 16 in the opening direction and the weight of the door 16 itself, the rotation of the door 16 is restrained in the opening direction beyond the angle of the door 16 at the time when the rotation restricting shaft 32 comes into contact with the slope 36. Because of this reason, the angle of the door 16 at the time when the rotation restricting shaft 32 is in contact with the slope 36 is a rotation restricting angle.

Though an accommodated baby inside the hood 12 may apply force that rotates the door 16 in the opening direction to the door 16 by pushing the door 16 by the foot or the like from the inside of the hood 12, the baby cannot apply the force strong enough to the door 16 to lift it up. Therefore, if the rotation restricting shaft 32 is located above the bottom 35 of the recess 33 and the angle of the door 16 is smaller than the rotation restricting angle, the door 16 is not rotated beyond the rotation restricting angle as shown in FIG. 5 even in the case that the door 16 is pushed by the foot or the like of the accommodated baby from the inside of the hood 12 under the state wherein it is not fixed to the closing state by the door fixing device 23.

Besides, since the rotation restricting angle is smaller than the critical angle, even if the door 16 is pushed by the foot or the like of the accommodated baby from the inside of the hood 12 under the state wherein it is not fixed in the closing state by the door fixing device 23, the door 16 is rotated in the direction to close the nursing window 15 by its own weight and the angle of the door 16 becomes smaller than the rotation restricting angle once the accommodated baby stops pushing the door 16 from the inside of the hood 12. Because of this reason, the environment inside the hood 12 is maintained to the physiological environment appropriate for the accommodated baby.

Also, as shown in FIG. 5, the angle where the rotation restricting shaft 32 finishes sliding down on the slope 36 toward the inside of the recess 33, namely, the rotation restricting angle is larger than the angle of the door 16 that is in contact with the outside surface of the nursing window opening and closing knob receiver 25 under the state wherein the nursing window opening and closing knob 24 is rotated up to the same angle position as the angle position where it is fitted into the nursing window knob receiver 25. Because of this reason, even if the door 16 is rotated in the direction to close the nursing window 15 under the state wherein the nursing window opening and closing knob 24 is rotated to the above mentioned angle position, the angle of the door 16 has already become smaller than the rotation restricting angle at the time when the nursing window opening and closing knob 24 comes into contact with the outside surface of the nursing window opening and closing knob receiver 25.

Therefore, even if the door 16 is rotated under the state wherein the nursing window opening and closing knob 24 is rotated up to the same angle position as the angle position wherein it is fitted into the nursing window opening and closing knob receiver 25, or even if the portion of the door 16 near the nursing window opening and closing knob 24 warps to the outside surface, the angle of the door 116 becomes smaller than the rotation restricting angle if the door 16 is rotated until the angle of the door 16 becomes smaller than the critical angle. Also, unless the door 16 is rotated until the angle of the door 16 becomes smaller than the critical angle, the angle of the door 16 does not become smaller than the rotation restricting angle, but since the door 16 rotates in the direction to open the nursing window 15 by its own weight, the operator can close the nursing window 15 again through immediate recognition of the opening of the nursing window 15.

Although the rotation shaft 21 and the rotation restricting shaft 32 are provided on the side of the door 16 and the bearing hole 22 and the recess 33 are provided on the side of the hood 12 in the incubator 11 of the above embodiment, the positional relationship between them can be set reversely. The shape of the recess 33 can also be shape other than the shape used in this incubator 11. For example, it is possible to allow the lack of the slope 37 to the recess 33. Also, while depending on whether the angle of the door 16 to the nursing window 15 is larger or smaller than the critical angle, the door 16 is rotated by its own weight either in the direction to open the nursing window 15 or in the direction to close it. To cause this rotation, a biasing force other than its own weight may be applied to the door 16.

What is claimed is:

1. An incubator comprising:

an incubator hood provided with a nursing window affording access to an interior of the hood;

a door adapted to close said window and swingable between open and closed positions relative to said hood;

a pivot arrangement comprising a member on said door and a member on said hood cooperating with the member on said door to enable rotation of said door between said open and closed positions, said members defining a center of rotation of said door shiftable between a first position and a second position relative to said hood and biased toward said first position;

a door-rotation restrictor between said door and said hood defining a critical angle of said door with said window between said open and closed positions such that when said door is between said critical angle and said closed position said door automatically tends to swing into said closed position and when said door is between said critical angle and said open position, said door automatically tends to swing into said open position, said door-rotation restrictor including means for restraining movement of said door between a rotation restricting angle less than said critical angle until said center of rotation is shifted into said second position and enabling movement of said door between said rotation restricting angle and said closed position with said center of rotation in said first position; and a door fixing device for securing said door in said closed position.

2. The incubator defined in claim 1 wherein one of said members is provided with a pivot shaft and the other of said members is provided with an elongated hole receiving said pivot shaft, said first position being defined by movement of said pivot shaft to one end of said elongated hole and said second position being defined by movement of said pivot shaft to an opposite end of said elongated hole.

3. The incubator defined in claim 1 wherein said door-rotation restrictor comprises a rotation restricting shaft spaced from said center of rotation and on one of said hood and said door and received in a recess, and a surface of said recess on the other of said hood and said door and juxtaposed with said rotation restricting shaft, said surface including a top engageable by said rotation restricting shaft to define said critical angle, and a slope extending downwardly from said top and engageable by said rotation restricting shaft to define said rotation restricting angle.

4. The incubator defined in claim 1 wherein the weight of the door biases said door into said first position.

5. The incubator defined in claim 4 wherein one of said members is provided with a pivot shaft and the other of said members is provided with an elongated hole receiving said pivot shaft, said first position being defined by movement of said pivot shaft to one end of said elongated hole and said second position being defined by movement of said pivot shaft to an opposite end of said elongated hole.

6. The incubator defined in claim 5 wherein said door-rotation restrictor comprises a rotation restricting shaft spaced from said center of rotation and on one of said hood and said door and received in a recess, and a surface of said recess on the other of said hood and said door and juxtaposed with said rotation restricting shaft, said surface including a top engageable by said rotation restricting shaft to define said critical angle, and a slope extending downwardly from said top and engageable by said rotation restricting shaft to define said rotation restricting angle.

7. The incubator defined in claim 6 wherein said pivot shaft and said rotation restricting shaft are provided on said door and said elongated hole and said recess are formed on said hood.

* * * * *